US005973583A

United States Patent [19]

Watanabe et al.

[11] Patent Number: 5,973,583

[45] Date of Patent: Oct. 26, 1999

[54] CORE ASSEMBLY FOR COIL UNITS AND METHOD FOR PRODUCING THE SAME

[75] Inventors: Kunihiko Watanabe, Yokkaichi; Toshiro Shimada, Osaka, both of Japan

[73] Assignees: Sumitomo Wiring Systems, Ltd.; Sumitomo Electric Industries, Ltd., both of Japan

[21] Appl. No.: 09/030,667

[22] Filed: Feb. 25, 1998

[30] Foreign Application Priority Data

Mar. 7, 1997 [JP] Japan ..... 9-052907

[51] Int. Cl.[6] ..... H01F 27/02; H01F 27/24

[52] U.S. Cl. ..... 336/131; 336/59; 336/60; 336/212; 320/108

[58] Field of Search ..... 320/108; 336/DIG. 2, 336/131, 132, 83, 82, 59, 60, 212

[56] References Cited

U.S. PATENT DOCUMENTS

| | | | |
|---|---|---|---|
| 3,675,108 | 7/1972 | Nicholl | 320/108 |
| 5,408,209 | 4/1995 | Tanzer et al. | 336/60 |
| 5,412,304 | 5/1995 | Abbott | 320/108 |
| 5,680,028 | 10/1997 | McEachern | 336/DIG. 2 |
| 5,719,483 | 2/1998 | Abbott et al. | 336/66 |

FOREIGN PATENT DOCUMENTS

| | | |
|---|---|---|
| 1188765 | 6/1985 | Canada . |
| 0657901 | 6/1995 | European Pat. Off. . |
| 449219 | 2/1943 | France . |

OTHER PUBLICATIONS

Copy of WO 94 09544 A (Electrical Power Res Inst) Apr. 1994 Patent Abst. Japan, vol. 095, No. 010, Nov. 30, 1995 (1 pg).

*Primary Examiner*—Michael L. Gellner
*Assistant Examiner*—Anh Mai
*Attorney, Agent, or Firm*—Jordan B. Bierman; Bierman, Muserlian and Lucas

[57] ABSTRACT

A core assembly for coil units and a method for producing the same which can suppress a raise of temperature are provided. A secondary core (21) made of a ferrite includes a pair of core members (25, 25) which are symmetrical with respect to each other and are adapted to be coupled to each other. Each core member (25) is provided in its coupling surface (44) with a groove or apertune (43). When the core members (25, 25) are coupled to each other, the integrated grooves (43, 43) define a flow path (40) adapted to flow a cooling medium in the secondary core (21). Thus, it is possible to form a flow path in a core made of a sintered material which is too hard to be worked.

4 Claims, 7 Drawing Sheets

CORE ASSEMBLY FOR COIL UNITS AND METHOD FOR PRODUCING THE SAME

BACKGROUND OF THE INVENTION

This invention relates to a core assembly for coil units which charges an electric car and to a method for producing the same.

In general, a magnetic coupling device includes a core assembly which constitutes a magnetic circuit for magnetically coupling a primary coil in a primary coil unit connected to an external power source device to a secondary coil in a secondary coil unit connected to a battery in the electric car. When both units are interconnected and the primary coil is energized, an induction electromotive force is generated in the secondary coil by a generated magnetic flux to charge the battery.

In such a magnetic coupling device, it is impossible to prevent a core of the core assembly from generating a heat due to a hysteresis loss of a magnetic material and the like. Consequently, there was a problem in which the magnetic coupling device as a whole is brought into a raise in temperature by a heat source of the core upon charging the battery.

SUMMARY OF THE INVENTION

A first object of the present invention is to provide a core assembly for coil units which can suppress a raise in temperature.

A second object of the present invention is to provide a method for producing a core assembly for coil unit which can suppress a raise in temperature.

In order to achieve the first object of the present invention, a core assembly for coil units which charges a battery device in an electric car by means of an external charging power source, the coil units including a primary coil unit connected to the external charging power source and a secondary coil unit connected to the battery device, in accordance with the present invention, comprises: a primary core for supporting a primary coil in the primary coil unit; and a secondary core for supporting a secondary coil in the secondary coil unit. The primary core has a pair of complementary primary core members. At least one of the complementary primary core members is provided in the coupling surface with a groove or aperture to form a first flow path adapted to flow a cooling medium in the primary core when the primary core members are coupled to each other. The secondary core has a pair of complementary secondary core members. At least one of the complementary secondary core members is provided in the coupling surface with a groove to form a second flow path adapted to flow a cooling medium in the secondary core when the secondary core members are coupled to each other. Consequently, the coil units form a magnetic circuit between the primary coil and the secondary coil when the primary core is connected to the secondary core.

According to the above structure of the present invention, it is possible to cool a part of the core which is not exposed to an atmosphere and is easy to store a heat, thereby enhancing an efficiency of cooling, since the flow paths for flowing the cooling media are formed in the cores.

It is also possible to easily form the grooves in the cores upon production of the core assembly, since the groove is located in the coupling surface of the core member. The grooves are formed into the flow paths when the pair of core members are interconnected. Accordingly, it is not necessary to carry out a step of drilling, and thus it is possible to easily produce the core assembly for coil units.

In the core assembly for coil units, the first and second flow paths may be provided on the interiors with recesses and projections for causing a turbulent flow of the cooling media therein.

According to the above structure, since the cooling medium is brought into a turbulent flow in the flow paths, a cooling medium which is raised in temperature upon contact with the inner peripheral surfaces of the flow paths can be mixed with a cooling medium which is spaced away from the inner peripheral surfaces and is at a lower temperature. Accordingly, only the cooling medium at a high temperature does not flow along the inner peripheral surfaces of the flow paths, thereby enhancing an efficiency of cooling.

In either one of the core assemblies for coil units described above, the primary or secondary coil unit may be accommodated in a protection casing and the protection casing may be provided with communication holes adapted to communicate the flow paths with an exterior of the protection casing.

According to the above structure, since the cooling medium can be introduced into the flow paths in the core assembly for coil units from the exterior of the protection casing, the protection casing can protect the coil units without storing the heat in the protection casing.

In order to achieve the second object of the present invention, a method for producing a core assembly for coil units, comprises the steps of: charging a ferrite powder in a mold adapted to form each of a pair of complementary core members; compressing the ferrite powder in the mold to form a groove in a coupling surface of the core member; sintering the ferrite powder compressed in the mold; and securing the pair of complementary core members together with each other through each coupling surface.

According to the method of the present invention, it is possible to produce the core assembly for coil units having the flow paths therein even if the core is made of the sintered ferrite powder which is too hard to be worked.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE PREFERRED EMBODIMENTS

Embodiments of a core assembly for coil units and a method for producing the same in accordance with the present invention will be described below by referring to FIGS. 1 through 8.

Figure 1:
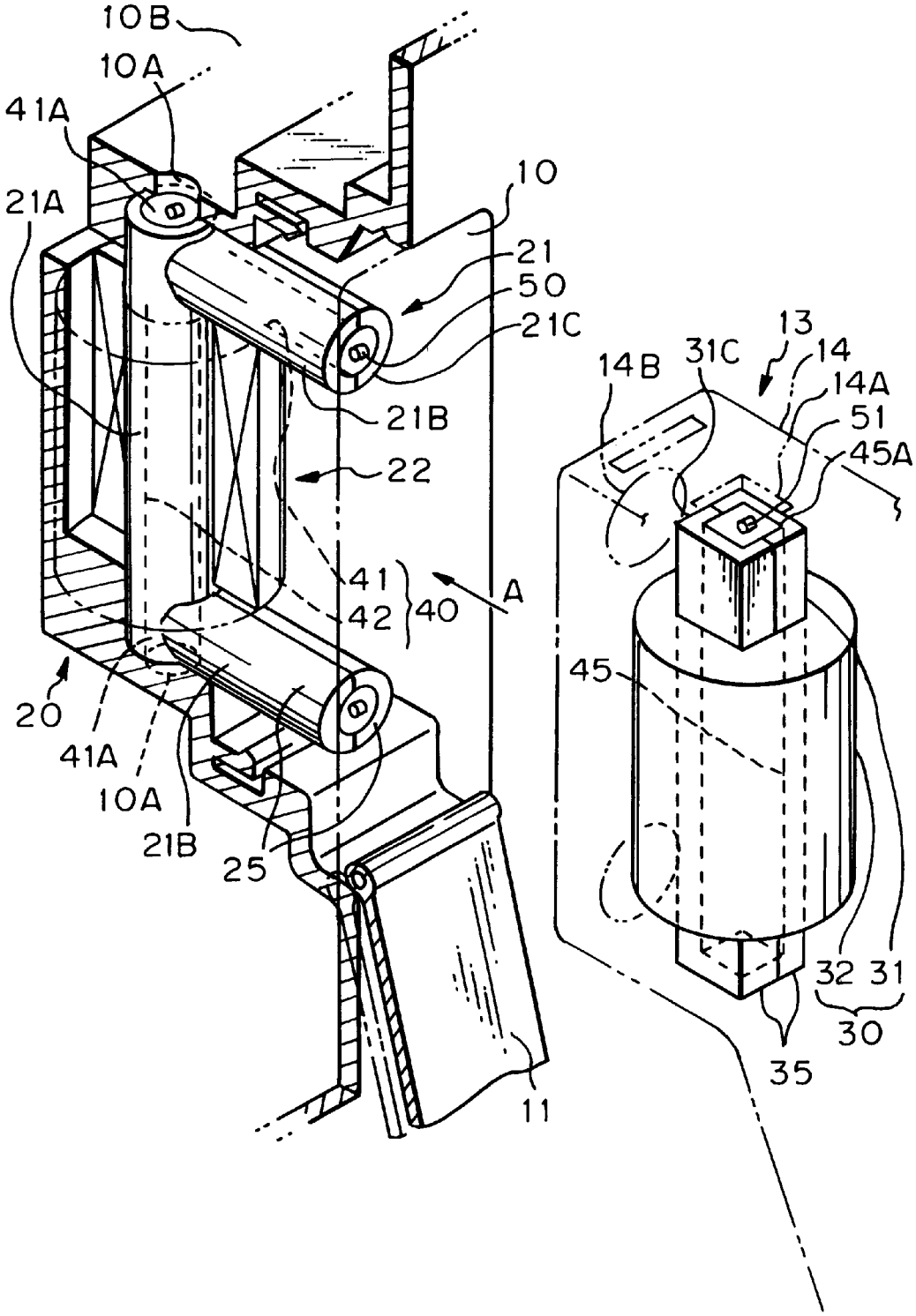
FIG. 1 is a perspective view of a charging device provided with an embodiment of a core assembly for coil units in accordance with the present invention.

As shown in FIG. 1, an electric car is provided in a side of a car body with a receiving part 10 which is open outwardly. A lid 11 is rotatably attached to an opening of the receiving part 10. A secondary coil unit 20 is located in an interior of the receiving part 10. The receiving part 10 is adapted to detachably receive a coupler 13 secured to an end of a power cable for charging (not shown) which extends from an external charging device (not shown) when the coupler 13 is inserted into the receiving part 10 along a direction shown by an arrow A in FIG. 1.

The secondary coil unit 20 includes a secondary core 21 produced by, for example, sintering a ferrite powder and a secondary coil 22 wound on the secondary core 21. Output terminals of the secondary coil 22 are connected to a charging circuit which charges a power battery (not shown) in a storage device in the electric car by rectifying a high frequency electromotive force induced in the secondary coil 22.

The secondary core 21 has an angular C-shape in a side elevational view with a vertical beam 21A and a pair of horizontal beams 21B which horizontally extend from opposite ends of the vertical beam 21A. The secondary core 21 is secured to an inner wall of the receiving part 10 with the vertical beam 21A being disposed on an inner side in the receiving part 10 and the horizontal beams 21B extending toward an opening of the receiving part 10. The secondary coil 22 is wound on the vertical beam 21A. A distal end surface of the horizontal beam 21B defines a coupling surface 21C adapted to be connected to the primary core 31. The coupling surface 21C will be explained hereinafter.

Figure 2:
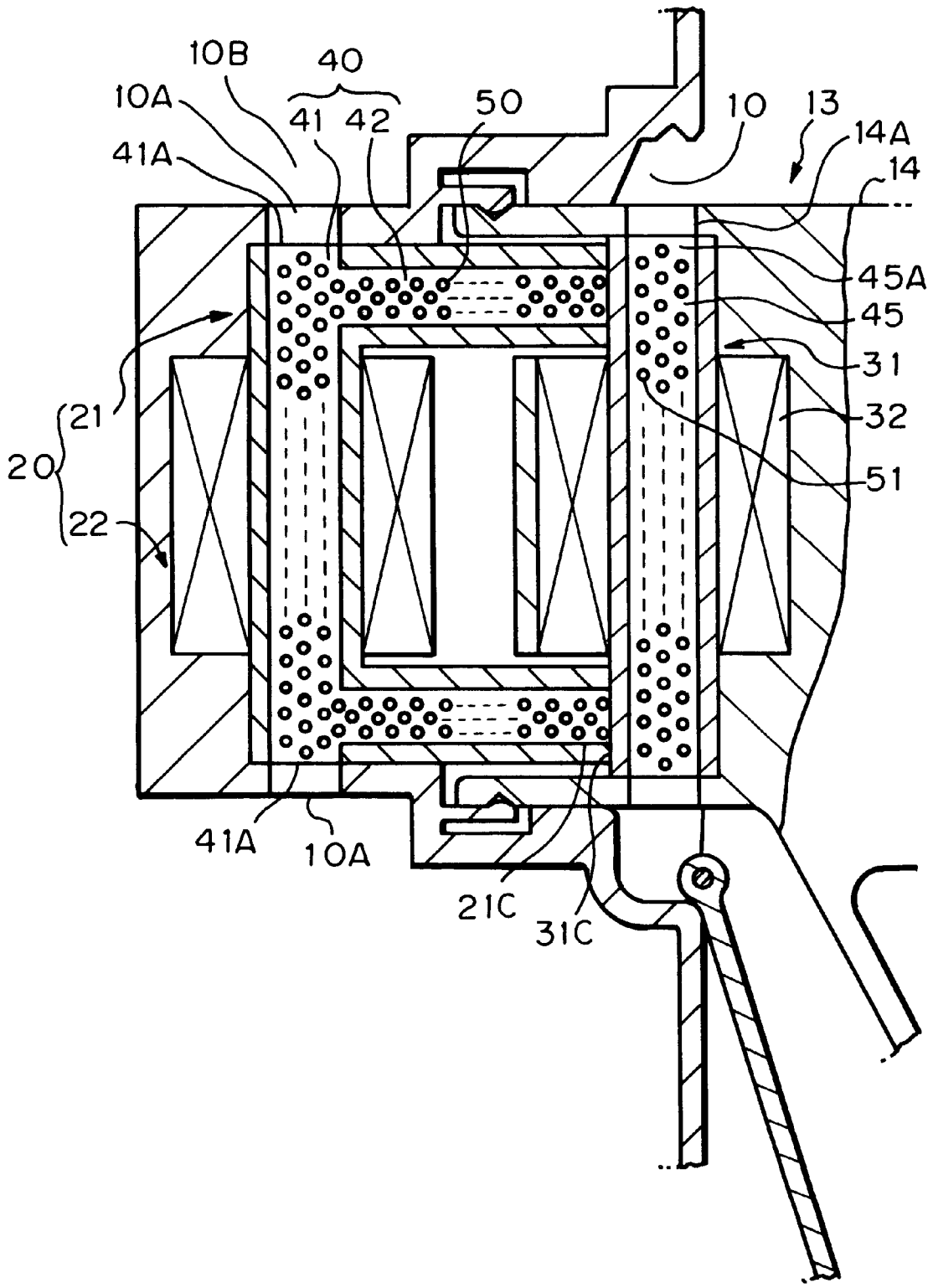
FIG. 2 is a longitudinal sectional view of a part of the charging device shown in FIG. 1, illustrating a charging state of the device.

The vertical beam 21A and horizontal beams 21B of the secondary core 21 are formed into round tubes. The interiors of the respective beams 21A and 21B are communicated with each other, as shown in FIG. 2, to define a flow path 40 adapted to flow a cooling medium. The flow path 40 includes a passage 41 in the vertical beam 21A and a passage 42 in the horizontal beam 21B. The passage 41 in the vertical beam 21A is provided in the opposite ends with openings 41A, 41A. The openings 41A are faced to a wide space 10B in a car body of the electric car through openings 10A in the inner walls of the receiving part 10. Thus, an air in the space 10B flows freely in the passage 41 as a cooling medium for cooling the secondary core 21. The flow path 40 is provided on its inner peripheral surface with a plurality of embosses 50 (FIG. 2).

Figure 3:
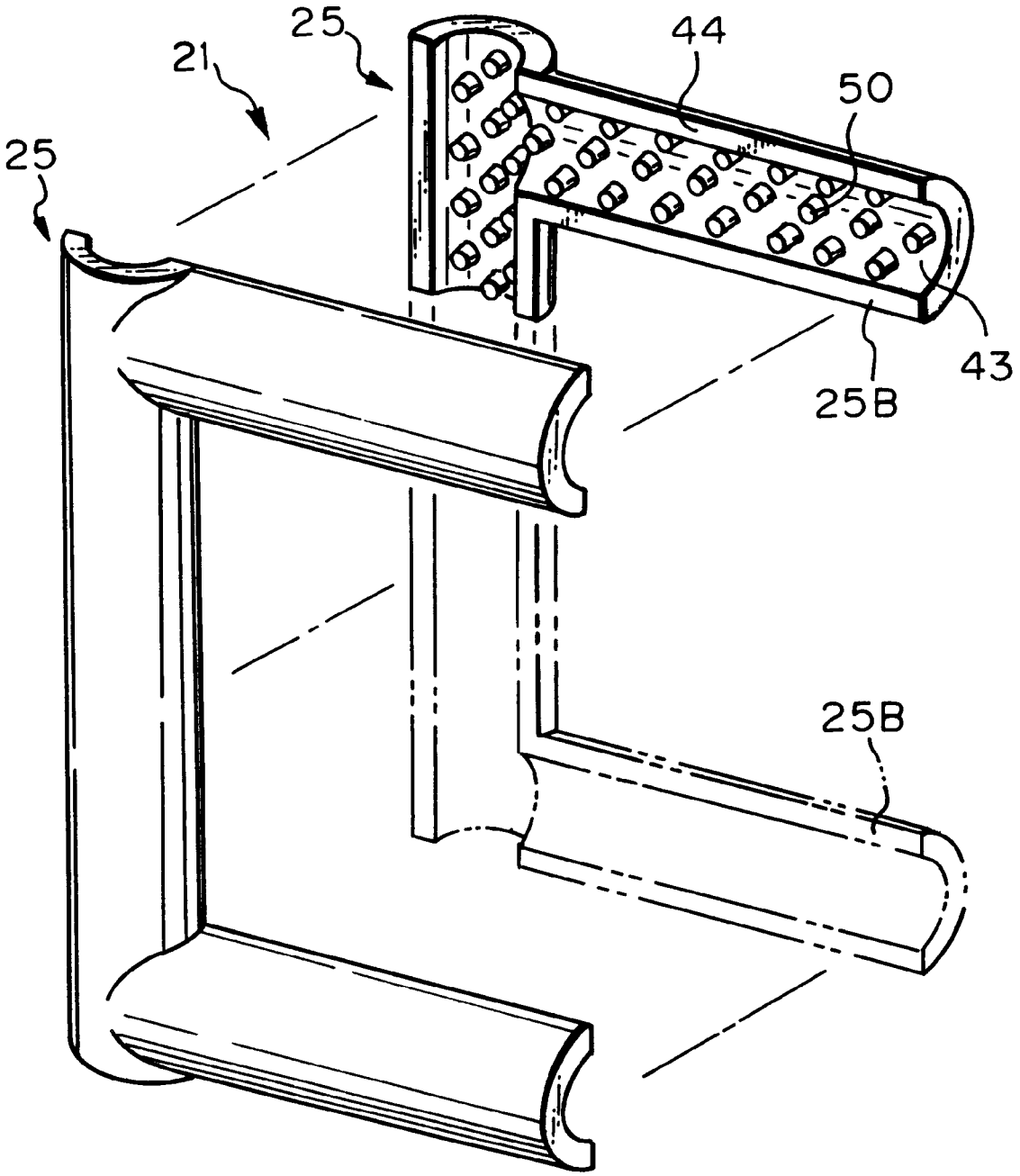
Fig. 3 is an exploded perspective view of secondary core members of a secondary core in an embodiment of the core assembly in accordance with the present invention.

As shown in FIG. 3, the secondary core 21 includes a pair of core members 25, 25 which are symmetrical with respect to a plane containing central axes of the vertical and horizontal beams 21A and 21B. Each core member 25 is provided in its coupling surface 44 with a groove or aperture 43 having a semicircular shape in cross section. When one groove 43 in one core member 25 is joined to the other groove 43 in the other core member 25, the flow path 40 is defined in the secondary core 21. The embosses 50 on the inner peripheral surface of the groove 43 extend toward the mating groove 43 in the mating core member 25. The secondary core 21 is produced by a method described hereinafter, that is, by forming each core member firstly, and then coupling the core members to each other. Thus, the flow path 40 can be easily formed in the secondary core 21.

The coupler 13 has a housing 14 adapted to be fitted in the receiving part 10. The housing 14 contains a primary coil unit 30 comprising a primary coil 32 and a primary core 31. The primary core 31 has an angular tube in cross section. The primary core 31 is provided in the opposite ends with openings, thereby defining a flow path 45 for flowing a cooling medium. Openings 45A in the opposite ends of the flow path 45 are faced to an exterior of the housing 14 through holes 14A in the housing 14, thereby freely flowing an air as a cooling medium in the flow path 45. A plurality of embosses 51 are formed on an inner peripheral surface of the flow path 45.

A front end surface of the opposite ends of the primary core 31 defines a coupling surface 31C adapted to be coupled to the secondary core 21. The coupling surface 31C is faced to the coupling surfaces 21C through holes 14B in 25 the housing 14 (see FIG. 1). A primary coil 32 is wound on an intermediate part of the primary core 31. An end of the primary coil 32 is connected to a power cable for charging which extends from an external charging device.

Figure 4:
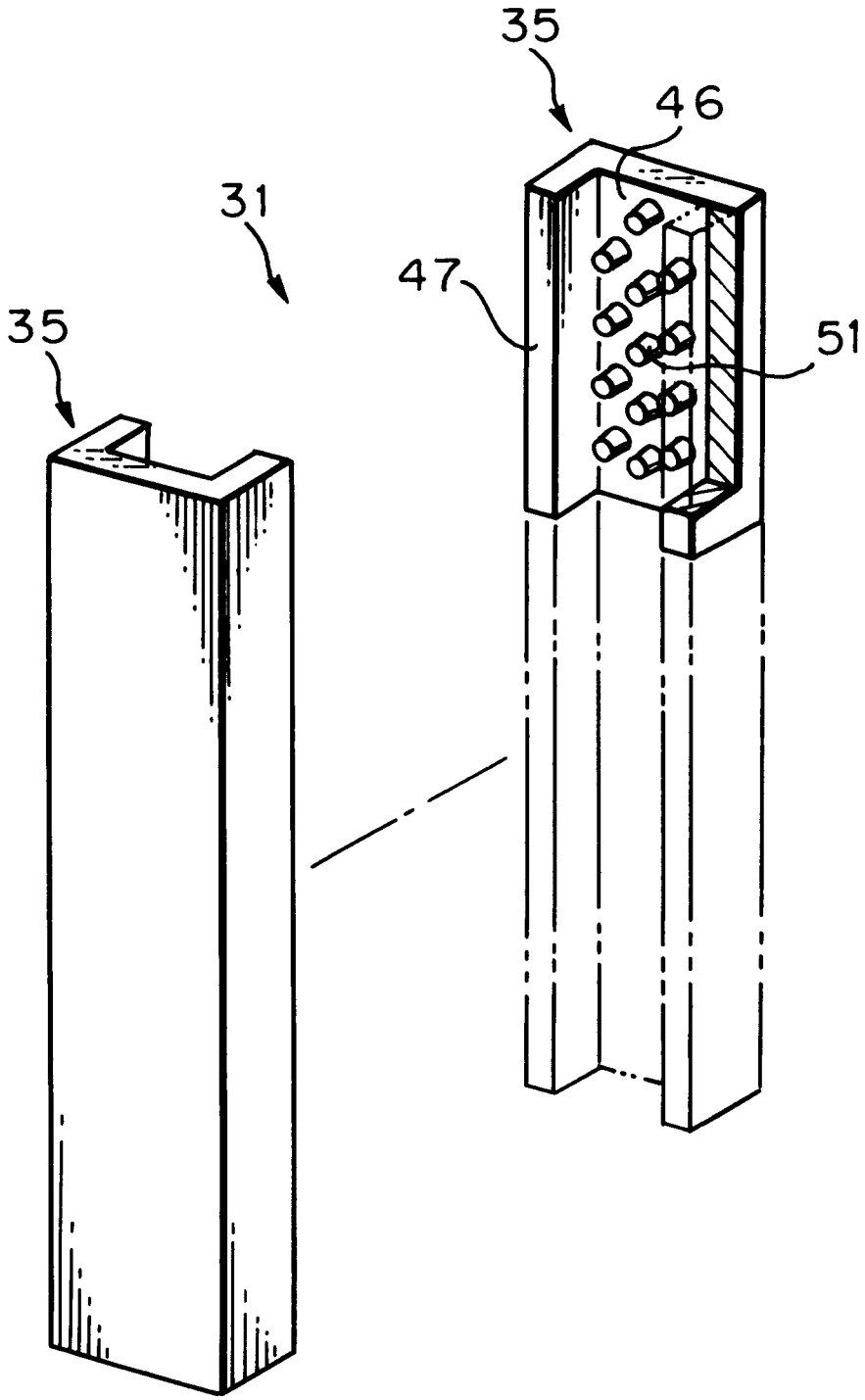
FIG. 4 is an exploded perspective view of primary core members of a primary core in an embodiment of the core assembly in accordance with the present invention.

As shown in FIG. 4, the primary core 31 includes a pair of core members 35 and 35 which are symmetrical with respect to a plane containing a central axis of the primary core 31 so as to correspond to the pair of the core members 25 and 25. Each core member 35 is provided in a coupling surface 47 with a rectangular groove 46 in cross section. 35 One groove 46 in one core member 35 is joined to the other groove 46 in the other core member to define the flow path 45.

A plurality of embosses 51 are provided on an inner peripheral surface of the groove 35 so that the embosses 51 extend toward the coupling surface of the mating core member 35. When the coupler 13 is inserted into the receiving part 10, the right and left core members 25, 25 and 35, 35 of the cores 21 and 31 are coupled to each other, thereby forming a magnetic circuit without causing the magnetic flux across the right and left core members upon charging. That is, the coupling surfaces 44 and 47 of the cores 21 and 31 extend along a direction of a magnetic flux. Accordingly, although the cores 21 and 31 are divided into core members 25, 25 and 35, 35, the core assembly of the present invention has the same efficiency of charging as that of cores which are not divided.

Figure 5:
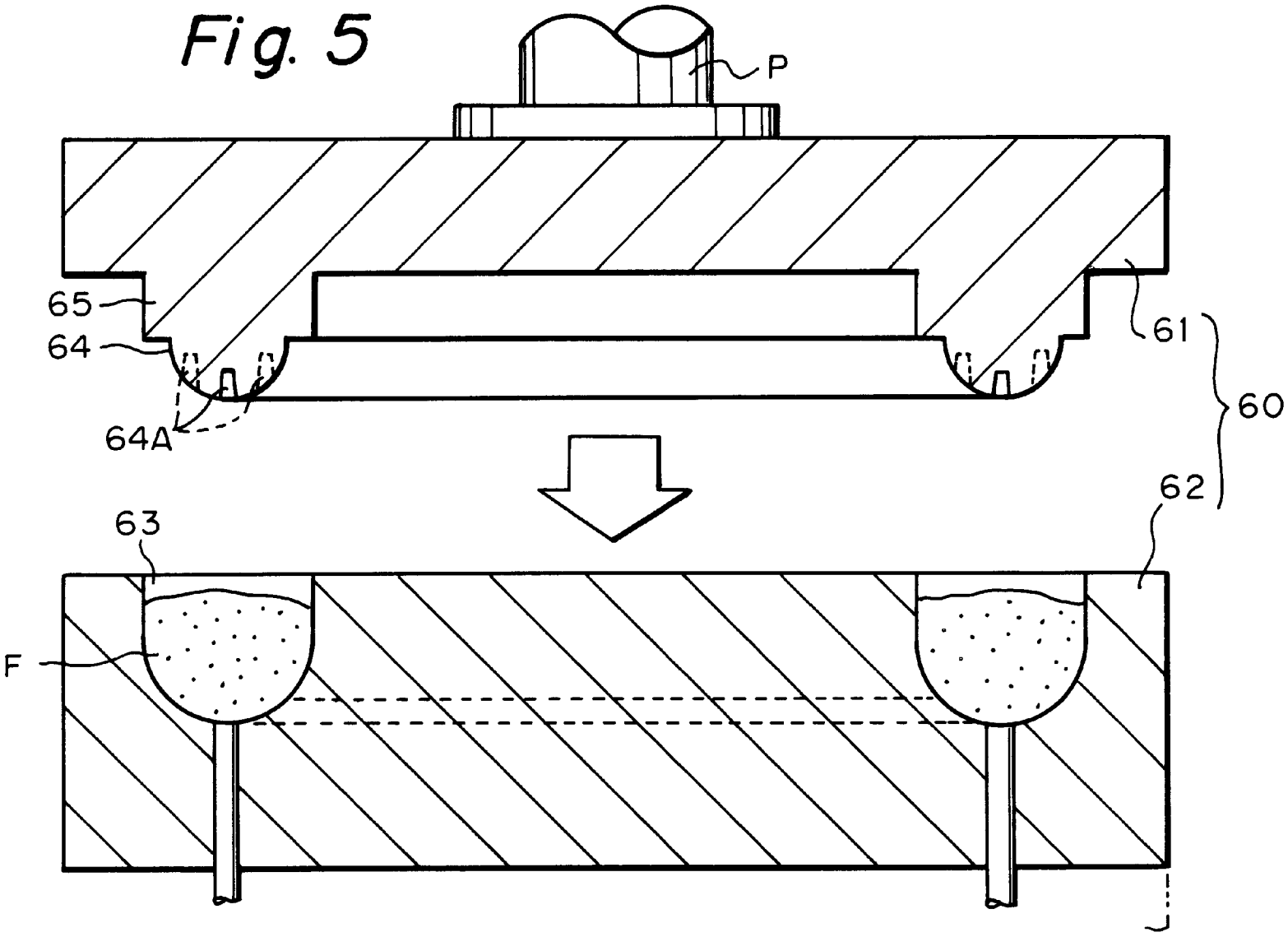
Fig. 5 is a cross sectional view of a mold assembly which compression-forms the secondary core members of the secondary core, illustrating an open position of the mold assembly.
Figure 6:
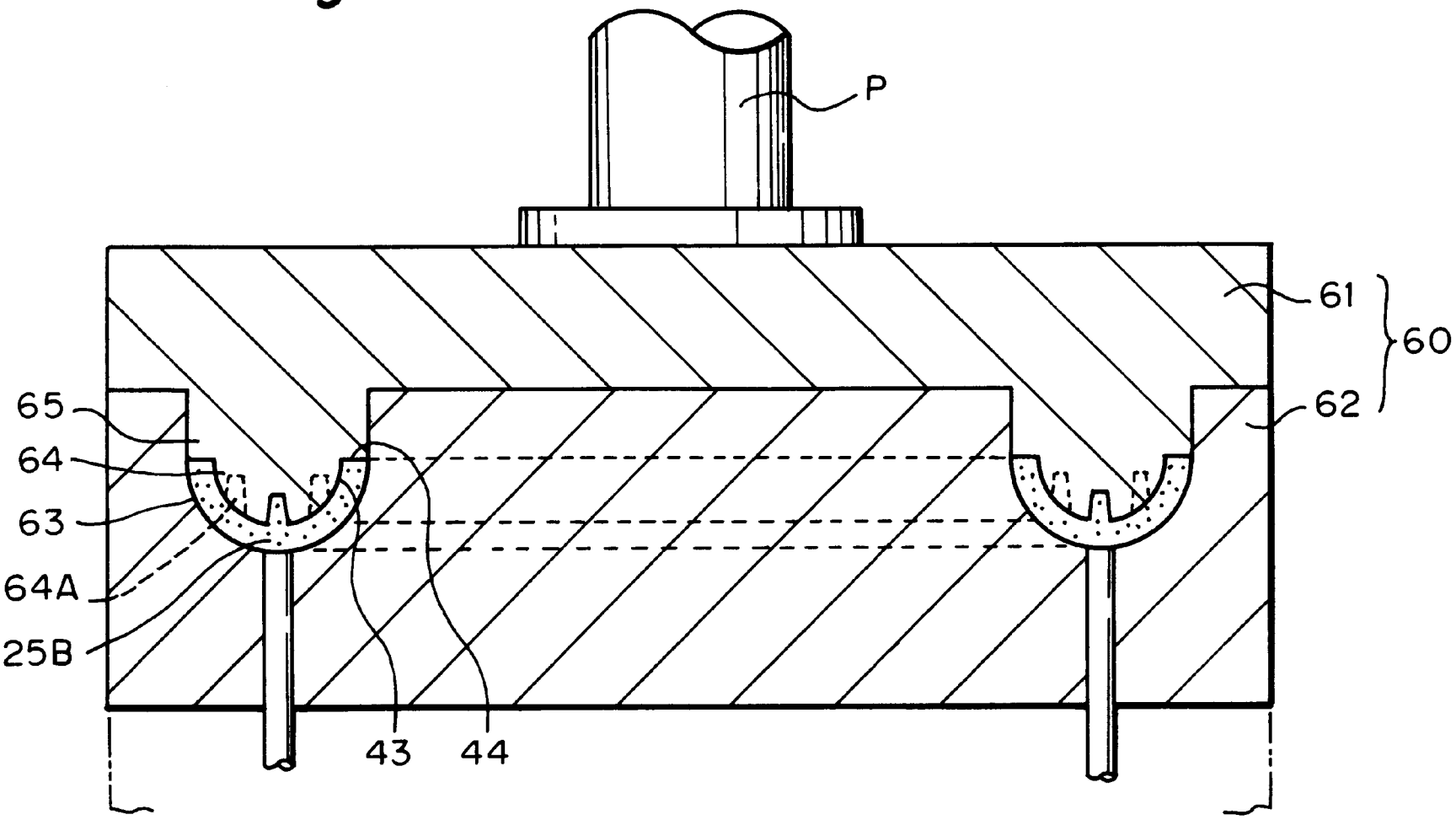
FIG. 6 is a cross sectional view of the mold assembly shown in FIG. 5, illustrating a closed position of the mold assembly.

Next, a method for producing the cores 21 and 31 will be explained below by referring to FIGS. 5 and 6.

After each core member is formed by interring a ferrite powder, the pairs of core members 25, 25 and 35, 35 are coupled to each other respectively to form the cores 21 and 31.

In a step of sintering, after the ferrite powder is brought into compression-forming in a mold assembly, the compression-formed ferrite powder is heated. FIGS. 5 and 6 are cross sectional views of a mold assembly 60, illustrating a portion corresponding to the horizontal beams 25B of the core member 25 (see FIGS. 3 and 6). The mold assembly 60 comprises an upper mold 61 and a lower mold 62 which are detachably coupled to each other in a vertical direction shown by an arrow in FIG. 5. The lower mold 62 is provided in its open surface with a recess 63 adapted to contain the ferrite powder. The upper mold 61 is provided in its open surface with a protrusion 65 to be fitted in the recess 63 so as to compress the ferrite powder (see FIG. 5).

The recess 63 has a semicircular shape which corresponds to the outer peripheral configuration of the core member 25. The protrusion 65 is provided with a ridge 64 having a semicircular shape which is coaxial with the semicircular shape of the recess 63. The ridge 64 serves to form the groove 43 in the coupling surface 44 of the core member 25. When the pair of core members 25, 25 are coupled to each other, the pair of grooves 43, 43 in the coupling surfaces 44 define the flow path 40. The ridge 64 is provided with a plurality of bores 64A with bottom walls. The bores 64A are arranged in a given pattern to extend toward an opening direction of the mold 61 so that the embosses 50 are formed on the inner peripheral surface of the flow path 40.

Although a mold assembly which carries out compression-forming of the core member 35 of the primary core 31 is not shown in the drawings, the mold assembly comprises a pair of molds, one of which has a recess adapted to contain a ferrite powder, and the other of which has a ridge adapted to form the groove 46. The ridge is also provided with bores for forming the embosses 51.

The core members 25 and 35 shown in FIGS. 3 and 4 can be obtained by sintering the compression-formed powder. The pair of core members are coupled to each other and secured to each other by means of, for example, an adhesive to form the cores 21 and 31. The pairs of grooves 43, 43 and 46, 46 in the core members 25, 25 and 35, 35 define the flow paths 40 and 45 which pass through the cores 21 and 31.

According to the embodiment of the producing method of the present invention, the grooves 43 and 46 are easily formed in the mold assemblies upon a process of sintering the ferrite powder, and the flow paths 40 and 45 can be formed in the cores 21 and 31 by joining the pairs of grooves 43, 43 and 46, 46 in the pairs of core members 25, 25 and 35, 35. Consequently, it is possible to readily produce the cores 21 and 31 provided with flow paths without working a hard sintered ferrite products. Since the coupling surfaces 44 and 47 of the core members 25 and 35 which are to be provided with grooves 43 and 46 are once exposed in the molds before coupling the molds, the coupling surfaces may be formed in a desired shape. Accordingly, even if the cores 21 and 31 have any complicated flow paths, for example, flow paths provided with the embosses 50 and 51, which are difficult to draw the mold from the openings 40A and 45A of the flow paths 40 and 45.

Next, an operation of charging an electric car will be described below.

When the coupler 13 is inserted into the receiving part 10, the horizontal beams 21B of the secondary core 21 enter the housing 14 through the holes 14B to bring the coupling surfaces 21C and 31C into contact with each other, thereby defining a rectangular magnetic circuit (FIG. 2). When the primary coil 22 is energized by the external electric device, a generated magnetic flux passes through the cores 21 and 31, an induction electromotive force is generated in the primary coil 22 by means of magnetic induction, and a power battery in the electric car is charged.

While charging the battery, a great magnetic flux is generated in the cores 21 and 31, so that the cores 21 and 31 radiate heat. However, since the cores 21 and 31 have the flow paths 40 and 45, the air which passes through the flow paths 40, 45 absorbs the heat from the cores 21 and 31 as a cooling medium, thereby suppressing the cores 21 and 31 from a raise in temperature.

Since the passage 41 in the vertical beam 21A out of the flow path 40 in the secondary core 21 and the flow path 45 in the primary core 35 extend in a vertical direction of the cores 21 and 31, the heated light air moves upwardly in the passage 41 and flow path 45 and is discharged through the upper openings into the exterior of the cores 21 and 31. At the same time, the cool heavy air flows into the passage 41 and flow path 45 through the lower openings.

The embosses 50 and 51 on the inner peripheral surfaces of the passage 41 and flow path 45 make a contact area with the cooling media great, thereby causing a turbulent flow of the cooling media. Such turbulent flow causes the cooling medium heated due to contact with the inner peripheral surfaces of the passage 41 and flow path 45 and the cooling medium at a lower temperature spaced away from the inner peripheral surfaces to be mixed with each other. Thus, only the cooling medium at a higher temperature does not flow along the inner peripheral surfaces of the passage 41 and flow path 45. This enhances an efficiency of cooling in the cores 21 and 31.

On the other hand, since the respective passages 42 in the horizontal beams 21B of the secondary core 21 are communicated with the passage 41 in the vertical beam 21A, the cooling medium at a higher temperature flows along the upper parts of the passages 42 in the horizontal beams 21B into the passage 41 in the vertical beam 21A while the cooling medium in the vertical beam 21A enters the passages 42 and flows along the lower parts of the passages 42 in the horizontal beams 21B. Thus, a flow of the cooling medium is also caused in the passages 42 in the horizontal beams 21B.

Consequently, a natural convection of the cooling media in the flow paths 40 and 45 in the cores 21 and 31 can eliminate the heat from the cores 21 and 31 efficiently.

According to the embodiment described above, even if the cores 21 and 31 radiate heat, the cooling media such as air which flow in the flow paths 40 and 45 can eliminate the heat and suppress the cores 21 and 31 from a raise in temperature. In addition, since the flow paths 40 and 45 pass through the cores 21 and 31, it is possible to effectively cool the interiors of the cores 21 and 31. Also, since the protection casing (walls of the receiving part and housing 14) for the cores 21 and 31 is provided with holes 10A and 14A, it is possible to introduce an air at a lower temperature from the exterior of the protection casing into the flow paths 40 and 45 and it is possible to protect the coil units 20 and 30 without storing the heat in the protection casing.

Moreover, since the flow paths 40 and 45 are formed by making the grooves 43 and 46 in the coupling surfaces 44 and 47 of the core members 25 and 35 and by coupling the pairs of the core members 25, 25 and 35, 35 to each other, it is possible to easily produce the cores 21 and 31 having the flow paths 40 and 45 without working the sintered products.

Figure 7:
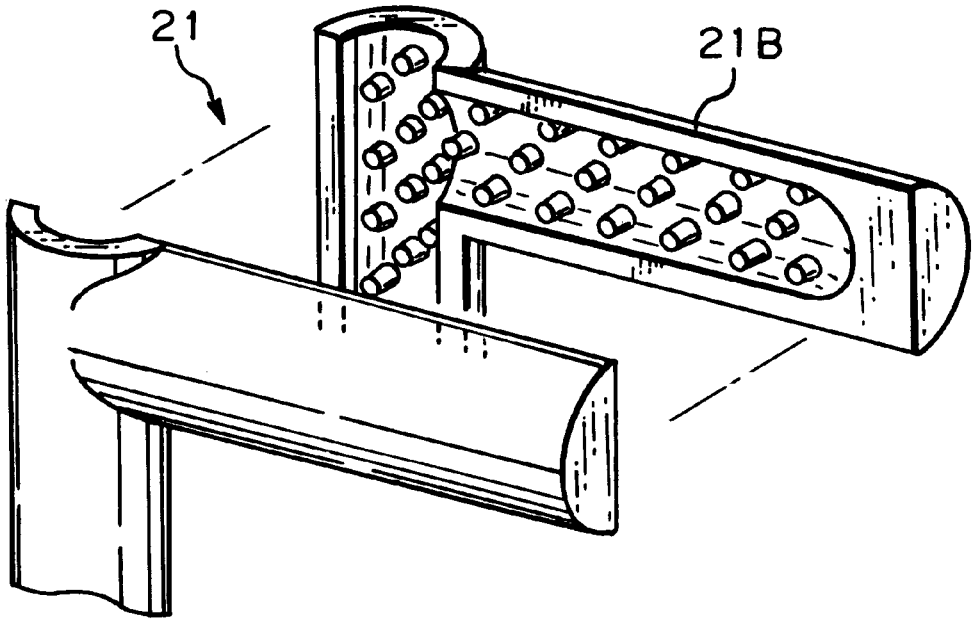
FIG. 7 is an exploded perspective view of another secondary core members of the secondary core shown in FIG. 3.

It should be noted that the present invention is not limited to the embodiments described above and, for example, alterations described below are contained in the technical scope of the present invention. Further, the present invention can be carried out in various alterations without deviating the gist of the present invention, except for the following alterations:

(1) Although the flow path 40 is open at the distal ends of the horizontal beams 21B of the secondary core 21 in the above embodiment, the distal ends of the horizontal beams 21B may be closed, as shown in FIG. 7. This structure can make a wider contact area between the cores 21 and 31 and form a stable magnetic circuit.

(2) Although the embosses 50 and 51 define projections for generating a turbulent flow in the passages in the above embodiment, the projections may be, for example, fins or triangular summits in cross section which are arranged along a flow direction of the cooling media on the peripheral surfaces of the flow paths.

(3) Although the grooves 43, 43 (46, 46) are formed in the pair of core members 25, 25 (35, 35) in the above embodiment, the groove 43 (46) may be formed in one of the core members 25 (35). Even if one of the core members which has a single groove is coupled to the other core member which has no groove, the single groove can define a flow path.

Figure 8:
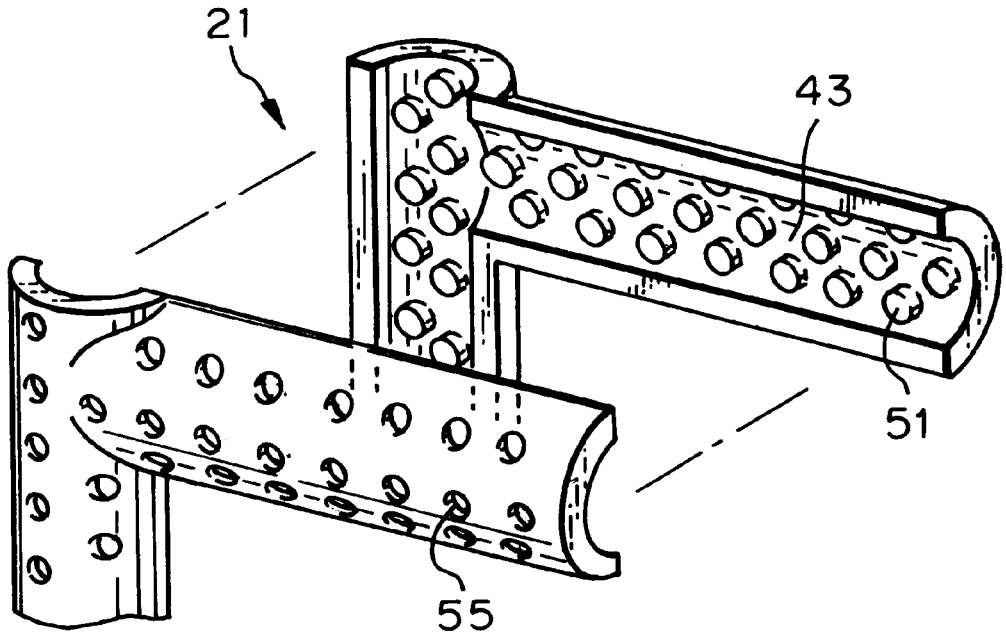
FIG. 8 is an exploded perspective view of still another secondary core members of the secondary core shown in FIG. 3.

(4) As shown in FIG. 8, dimples 55 may be formed in an outer peripheral surface of the core 21 so that the dimple 55 falls in the emboss 51, whereby the dimples 55 enhance heat radiation from the outer peripheral surface of the core 21.

(5) Moreover, the present invention can include an embodiment in which the flow path has no projection for generating a turbulent flow.

From the above description of the invention, those skilled in the art will perceive improvements, changes and modifications. Such improvements, changes and modifications within the skill of the art are intended to be covered by the appended Claims.

The entire disclosure of Japanese Patent Application No. HEI 9-52907 (1997) filed on Mar. 7, 1997, including specification, claims, drawings and summary is incorporated herein by reference in its entirety.

What is claimed is:

1. A core assembly for coil units which charges a battery device in an electric car by means of an external charging power source, said coil units including a primary coil unit connected to said external charging power source and a secondary coil units connected to said battery device, comprising:

a primary core for supporting a primary coil in said primary coil unit, said primary core having a pair of complementary primary core members, at least one of said complementary primary core members being provided in a coupling surface with a aperture to form a first flow path adapted to flow a cooling medium in said primary core when said primary core members are coupled to each other; and a secondary core for supporting a secondary coil in said secondary coil unit, said secondary core having a pair of complementary secondary core members, at least one of said complementary secondary core members being provided in the coupling surface with a aperture to form a second flow path adapted to flow a cooling medium in said secondary core when said secondary core members are coupled to each other;

whereby said coil units form a magnetic circuit between said primary coil and said secondary coil when said primary core is connected to said secondary core.

2. A core assembly for coil units according to claim 1 wherein said first and second flow paths are provided on the interiors with recesses and projections for causing a turbulent flow of said cooling media therein.

3. A core assembly for coil units according to claim 2 wherein said primary or secondary coil unit is accommodated in a protection casing and wherein said protection casing is provided with communication holes adapted to communicate said flow paths with an exterior of said protection casing.

4. A core assembly for coil units according to claim 1, wherein said primary or secondary coil unit is accommodated in a protection casing and wherein said protection casing is provided with communication holes adapted to communicate said flow paths with an exterior of said protection casing.

* * * * *